US005666704A

United States Patent [19]

Price et al.

[11] Patent Number: 5,666,704

[45] Date of Patent: Sep. 16, 1997

[54] DETWISTING MECHANISM FOR FABRIC PROCESSING LINE

[75] Inventors: Ellie E. Price, Charlotte; William C. Hardin, Jr., Lexington; Chris Bostian, Kannapolis, all of N.C.

[73] Assignee: Tubular Textile LLC, Lexington, N.C.

[21] Appl. No.: 716,940

[22] Filed: Sep. 20, 1996

Related U.S. Application Data

[60] Provisional application No. 60/005,284 Oct. 12, 1995.

[51] Int. Cl.[6] ..... D06C 3/06

[52] U.S. Cl. ..... 26/74; 26/99; 26/51; 57/1 UN

[58] Field of Search ..... 26/74, 99, 70, 26/51, 51.3, 51.4, 71, 80; 68/13 R; 57/1 UN, 31, 264; 28/142, 227, 228, 229, 225, 242

[56] References Cited

U.S. PATENT DOCUMENTS

| | | | |
|---|---|---|---|
| 2,117,603 | 5/1938 | Dungler | 57/1 UN |
| 3,693,336 | 9/1972 | Bassani | 57/1 UN |
| 3,813,862 | 6/1974 | Tsuchida | 57/1 UN |
| 4,106,004 | 8/1978 | Kuroda | 57/1 UN |
| 4,286,428 | 9/1981 | Bassani | 26/99 |
| 4,329,838 | 5/1982 | Zerle et al. | 57/1 UN |
| 4,631,911 | 12/1986 | Young, Jr. et al. | 26/74 |
| 4,766,719 | 8/1988 | Young, Jr. | 57/1 UN |
| 4,843,669 | 7/1989 | Koch et al. | 26/74 |
| 5,271,131 | 12/1993 | Jacumin | 26/74 |

*Primary Examiner*—Amy B. Vanatta

*Attorney, Agent, or Firm*—Schweitzer Cornman, Gross & Bondell LLP

[57] ABSTRACT

A improved upper level de-twisting mechanism is provided to facilitate the handling of rope form fabric as it is drawn from a bulk container, typically in wet condition, and conveyed to a processing operation, such as spreading. The mechanism includes a rigid support positioned under a lifting roller and mounting a poteye through which the fabric is drawn. Three or more grooved guide rollers engage the lower flange of the poteye, supporting it for rotation about its axis. A reversible drive motor is mounted along side the poteye and drive belts are trained about the drive motor output and the grooved external contours of the poteye for controllably rotating the poteye. Resiliently biased arms, each carrying a fabric engaging roller, are mounted on the top flange of the poteye, such that rope form fabric, passing through the poteye, is grippingly engaged between the rollers for positive twist control over the fabric when the poteye is rotated is response to a twist sensing device arranged to sense the condition of the fabric as it is conveyed from the container.

14 Claims, 5 Drawing Sheets

DETWISTING MECHANISM FOR FABRIC PROCESSING LINE

This application claims priority of provisional application Ser. No. 60/005,284, filed Oct. 12, 1995.

BACKGROUND AND SUMMARY OF THE INVENTION

In the processing of fabrics, particularly knitted fabrics, and more particularly still tubular knitted fabrics, preliminary processing operations typically include one or more wet processing operations such as washing, bleaching, dyeing, etc. In connection with at least some of these operations, the wet processed fabric is deposited in "rope" form into a container, to await further processing, frequently at a different location in the plant.

Further processing of the wet, rope-form fabric may involve preliminary steps of lifting the rope-form fabric out of its container and directing the fabric onto the entry section of a spreading device, for example. In the case of tubular knitted fabric, the spreading device typically is received internally of the fabric tube and serves to spread the fabric out to a flat, two-layer form, accompanied by lateral distention of the fabric to a desired width.

Typically, as wet processed fabric is lifted from its container, it may be severely twisted such that, as the fabric rope approaches the entry end of a spreader, the spreader may be unable to open up the fabric to allow the fabric to pass over the spreader frame. Were such a condition to occur, it would at best require immediate shut-down of the processing line while the condition was corrected. At worst, it could result in damage to both the spreader and to the fabric.

It has been common practice, in the past, to deal with the twisted fabric condition by placing the fabric container on a turntable, directly below a lifting roller by which the fabric is withdrawn from the container. A twist sensing device, in itself well known, is associated with the rope-form fabric at a point adjacent to the lifting roll, typically on the discharge side thereof. When the sensing device detects a twist condition in the fabric, a drive motor for the turntable is actuated to rotate the turntable in a direction tending to correct that condition.

Because the lifting roll frequently is spaced well above the supply of fabric in the container, a considerable response time can be involved between initiating rotation of the turntable (and the fabric container supported thereon) and the sensing of the effects thereof by the twist sensor. This arrangement can lead to a great deal of over-rotation or "hunting" of the turntable and fabric container. In the prior art, this problem has been dealt with by providing a second, upper level detwisting device, arranged to operate in synchronism with the corrective rotations of the turntable below, but acting directly upon the rope-form fabric itself at a point closely adjacent to the lifting roller. This arrangement provides for a rapid corrective response to the sensing of a twist condition, and avoids the excessive over-rotations of the turntable which were observed with more primitive systems. An example of the use of such an upper level detwisting device is disclosed in the Zerle et al. U.S. Pat. No. 4,329,838.

The present invention is directed to a novel and improved, simplified and more economical form of upper level detwisting mechanism for the purposes described. To this end, the detwisting mechanism of the invention is compact and lightweight, very economical to manufacture, yet ruggedly constructed and altogether suitable for the purpose intended. The mechanism of the invention includes a rotatably supported annular member through which the fabric rope passes in travelling from the supply container to the lifting roller. The annular member carries a pair of resiliently biased, opposed rollers that grip the fabric as it passes through. A reversible drive motor is mounted adjacent the annular member and is connected thereto by elastic belt means. The reversible drive motor is controlled in parallel with the rotational drive of the turntable below, so that the annular member is rotated in synchronism with the turntable. The fabric, which is gripped between the resiliently biased rollers, is rotated directly by such rollers, in accordance with rotations of the annular member, as controllably rotated by the drive motor.

In a specifically preferred embodiment of the invention, the annular member referred to above is a substantially conventional poteye, which is a commonly employed guiding element frequently used in the textile industry and widely available at low cost and in various sizes. The poteye is a ring-shaped element whose walls are of radially outwardly opening U-shaped cross section, defining upper and lower flanges and an intermediate annular recess. In the detwisting mechanism of the invention, such a poteye is mounted for rotation about a vertical axis by three or more annularly grooved support rollers which engage the lower flange of the poteye at spaced points about its periphery. The upper flange of the poteye serves to mount resiliently biased pivot arms, carrying gripping rollers at their upper ends. The annular recess formed between the upper and lower flanges serves to receive elastic driving belts, for controllably rotating the poteye. The arrangement is unusually simple and economical, yet rugged and reliable.

In another preferred form of the invention, a safety shut-off device is incorporated with the upper level detwisting mechanism whereby, if a tangled or knotted portion of the fabric rope approaches the detwisting mechanism, it is sensed in advance and the operation of the lifting roller is immediately halted, to prevent damage to the detwisting mechanism and/or to the fabric. Advantageously, the safety shut-off device includes a second annular member, of smaller diameter than the annular member previously referred to, through which the fabric rope passes immediately before entering the detwisting mechanism. The second annular member, which most advantageously is a conventional poteye of suitable diameter, is mounted for limited vertical movement and is associated with a shut-off switch. Whenever a knot or tangle encounters the second annular member, and is unable to freely pass through it, that member will be lifted by the upwardly moving fabric rope, causing the mechanism to be immediately shut off until the problem is corrected.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
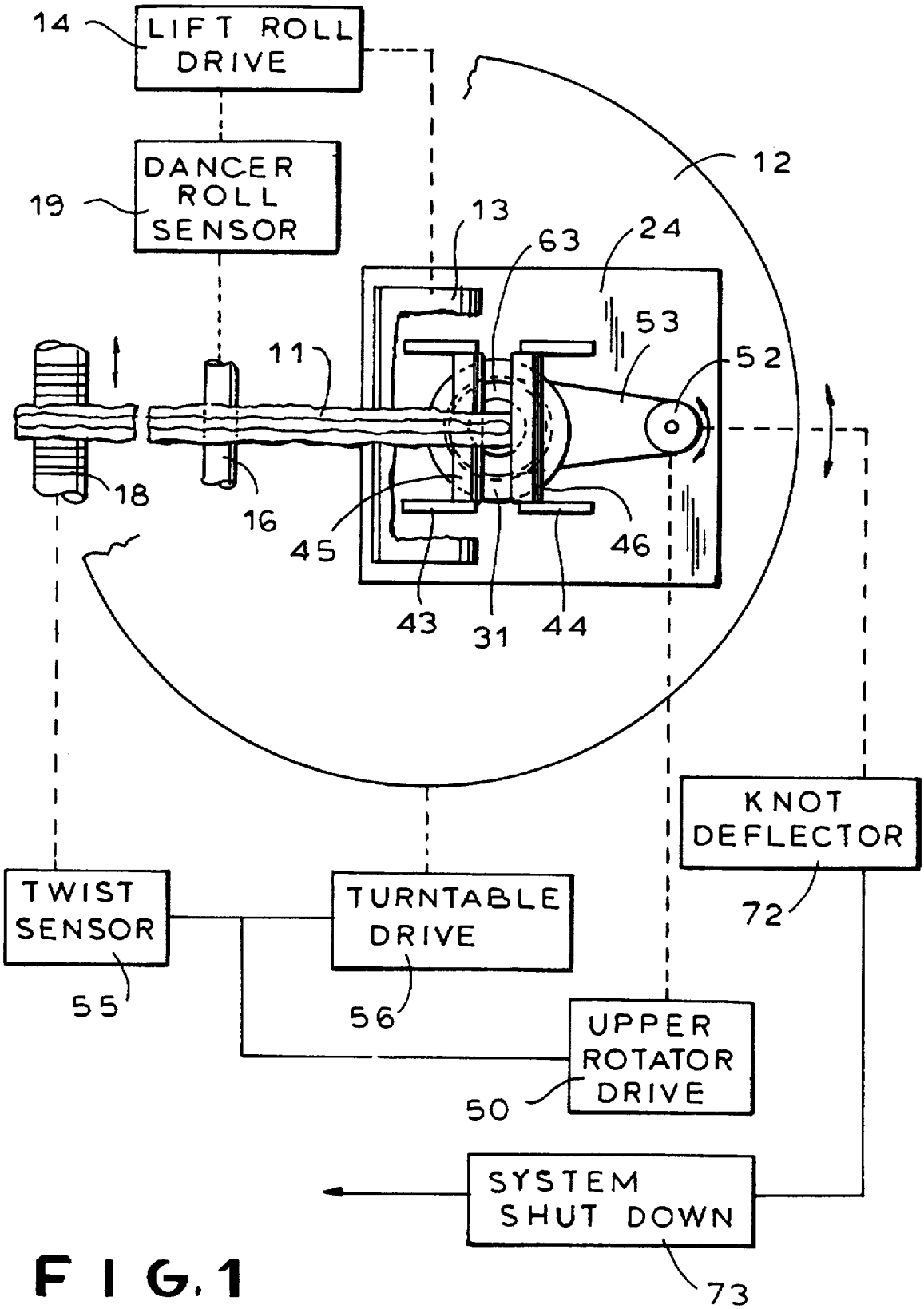
FIG. 1 is a schematic top plan view of a system for unloading wet fabric in rope-form and incorporating features of the invention.
Figure 2:
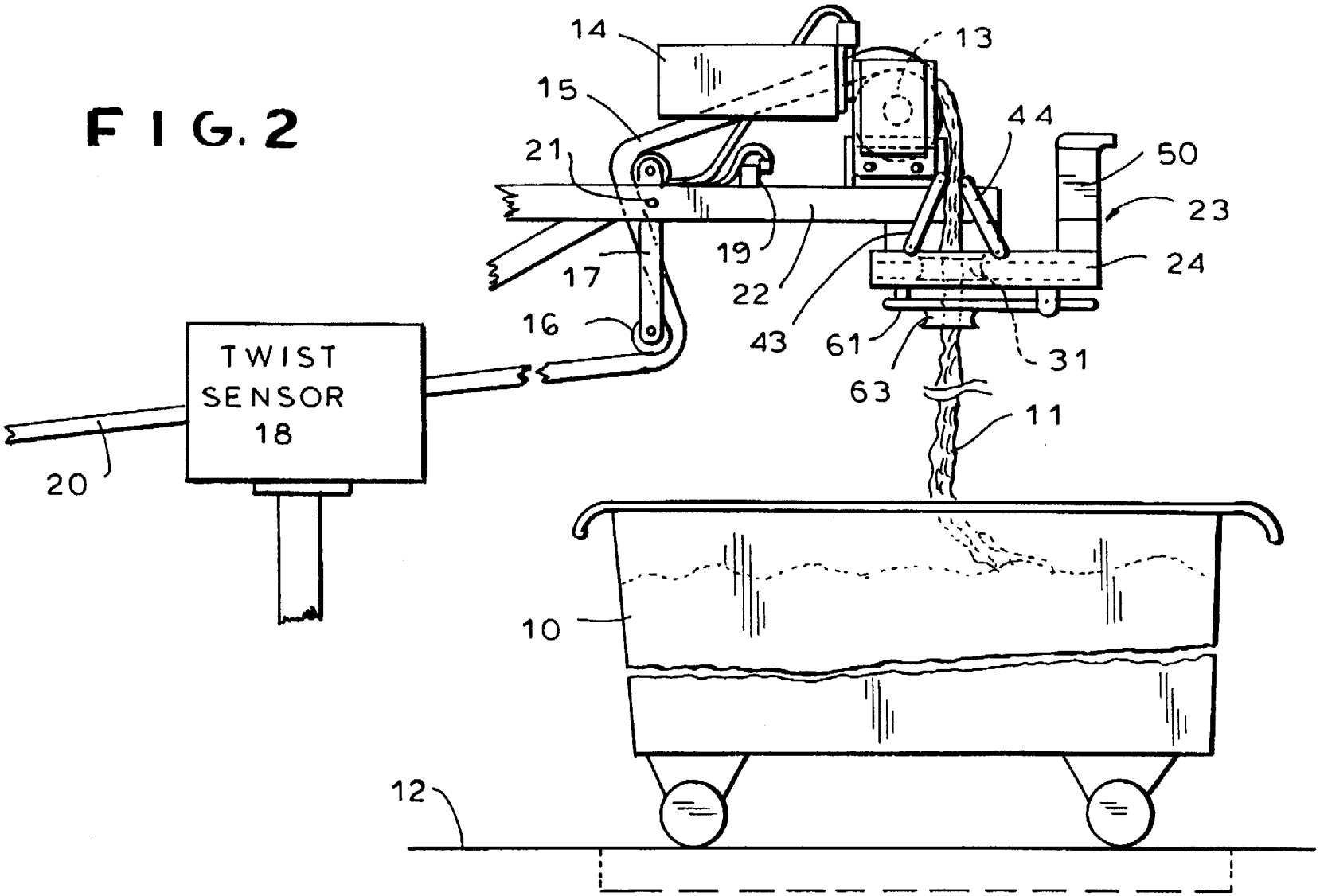
FIG. 2 is a side elevational view of the system of FIG. 1.

Referring now to the drawing, and initially to FIGS. 1 and 2 thereof, the reference numeral 10 designates a typical container holding a supply of wet tubular knitted fabric 11 in rope-form, as provided from a previous processing operation. The container 10 is mounted on a turntable 12, which is located directly below a power-driven lifting roller 13 operated by a suitable drive motor 14. The fabric 11, after passing over the lifting roller 13, is guided about a dancer roll assembly including upper and lower rollers 15, 16 mounted on pivot arms 17. The fabric is threaded over the roller 15 and under the roller 16 and then through a detwisting sensing device 18. The fabric is then directed to the next desired operation, typically spreading to width. The dancer roll mechanism 15–17 is associated with a control switch 19. When fabric 20 is called for by the next operation (not shown) the dancer assembly will be caused to rotate about its pivot 21 to actuate the drive motor 14 and lifting roller 13, thus drawing fabric from the container.

In the illustrated arrangement, the lifting roller 13 is mounted on a frame structure comprising a pair of spaced-apart structural elements 22. Mounted on these structural elements, directly below the lifting roller, is an upper level detwisting mechanism, generally indicated by the reference numeral 23, which forms the specific subject matter of this invention. The detwisting mechanism 23 is a self-contained assembly comprising a tray-like support 24, formed of suitable sheet metal material and defining a bottom wall 25, opposite side walls 26, 27 and end walls 28, 29. The support 24, which is rigidly mounted to the structural elements 22, is formed with a circular opening 30 in the bottom wall 25, for the passage of rope-form fabric being drawn upwardly from the container 10. The sheet metal material of which the support structure is formed advantageously is perforated as indicated representationally at 36 to accommodate easy drainage of any liquid released by the fabric in the course of operations.

Figure 3:
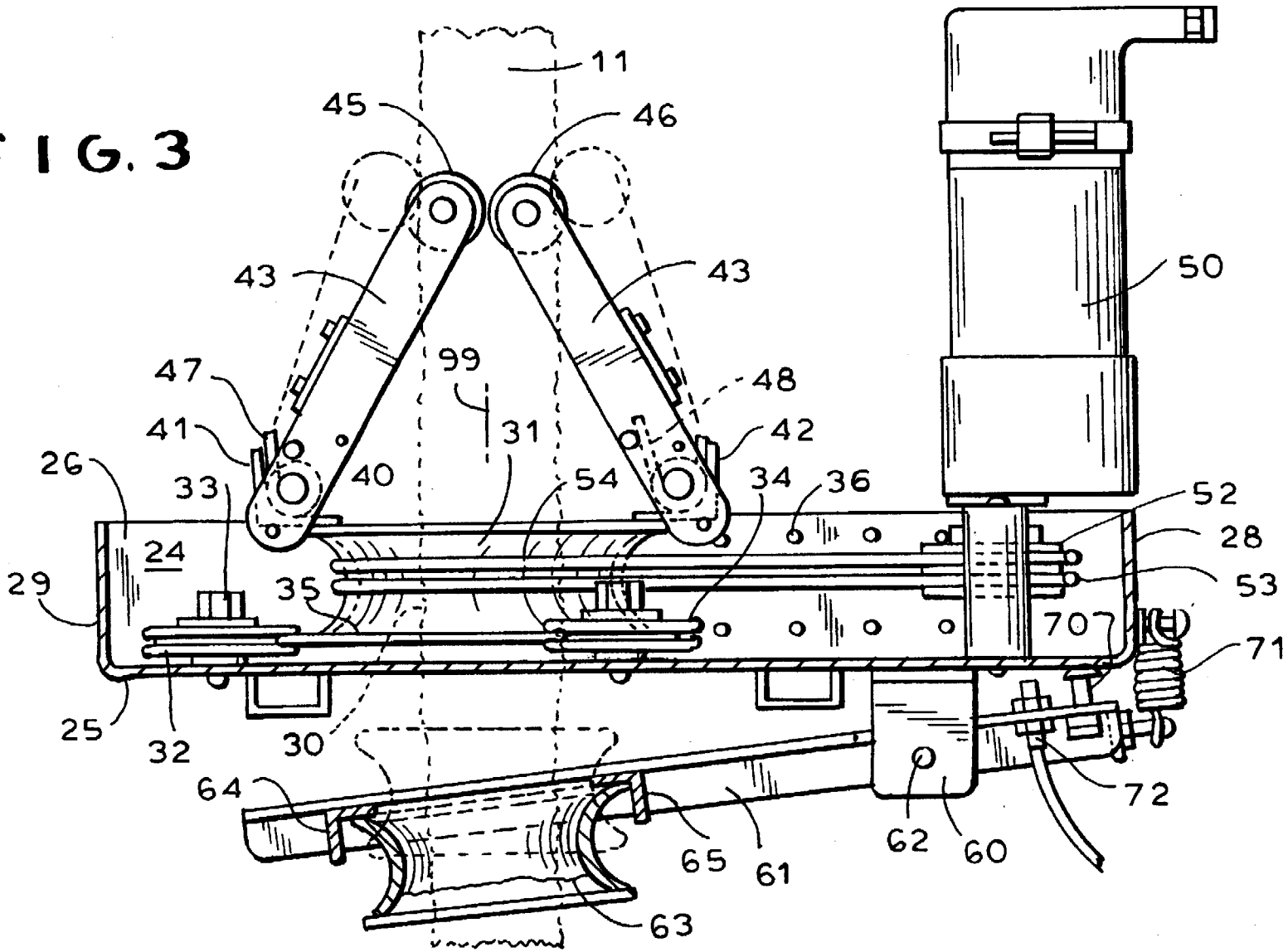
FIG. 3 is an enlarged elevational view, partly in section, of the upper level detwisting mechanism forming the subject matter of the invention.
Figure 4:
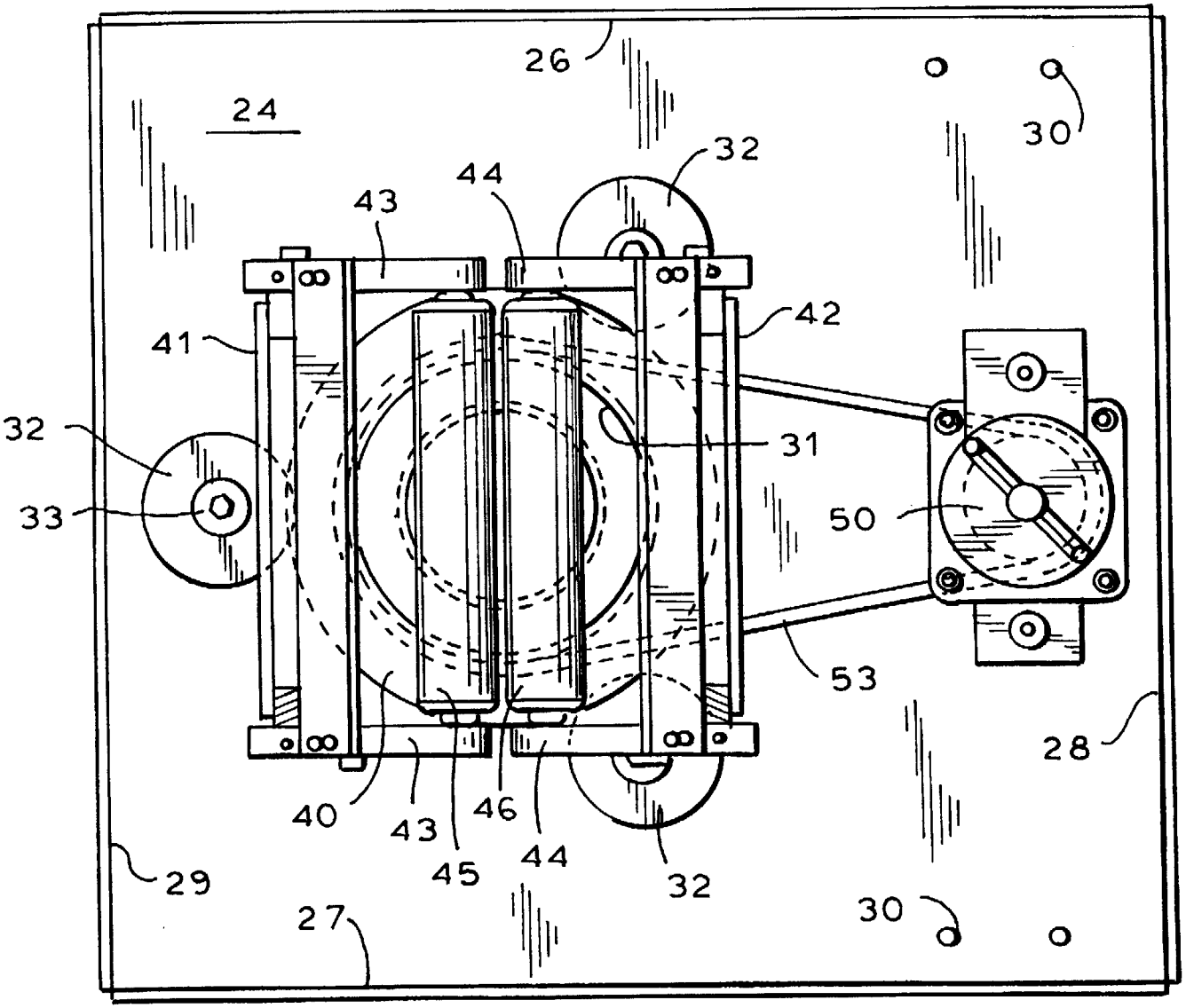
FIG. 4 is a top plan view of the mechanism of FIG. 3.
Figure 5:
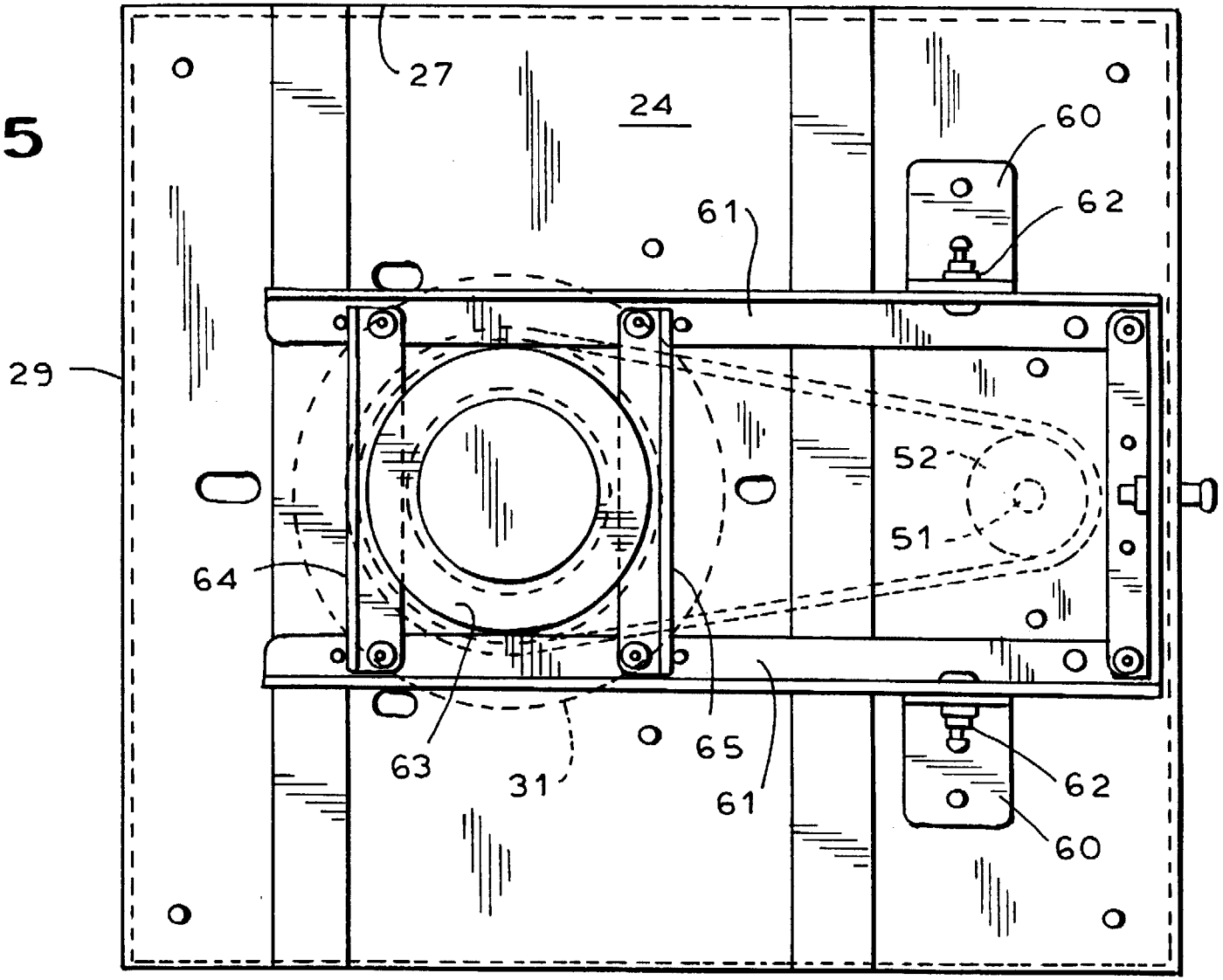
FIG. 5 is a bottom plan view of the mechanism of FIG. 3.

As reflected particularly in FIG. 3, an annular member 31, preferably a standard, commonly available, stainless steel poteye, is mounted for rotation on the support 24. Conveniently and economically, this is accomplished by provided three equally spaced, annularly grooved support rollers 32, rotatably mounted on the bottom wall 25 by bearing bolts 33. The annular groove 34 formed in each of the rollers 33 is arranged to closely receive a horizontally extending lower flange 35, forming an integral part of the poteye 31. At least one of the journal bolts 33 has an eccentric shaft portion whereby, upon controlled rotational adjustment, the axis of the associated support roller 32 may be moved toward or away from the flange 35. This provides for easy and economical rotatable mounting of the poteye, which is not necessarily a precision manufactured element.

Mounted on the top flange 40 of the poteye are diametrically opposed angle brackets 41, 42 which form pivot mountings for opposed pairs of arms 43, 44. At their upper ends, the arms 43, 44 mount freely rotating rollers 45, 46 respectively. At their lower ends, the pivot arms 43, 44 are pivoted on the angle brackets 41, 42 and are also associated with biasing springs 47, 48 arranged to urge the arms to pivot inwardly, toward the vertical central axis 49 of the poteye. Preferably, limit stops are provided so that the at-rest position of the arms is as shown in FIG. 3, with the rollers 45, 46 slightly separated. Desirably, the arrangement of the arms 43, 44 is such that the rollers 45, 46 are as close as practicable to the lifting roller 13.

At one side of the support 24, there is mounted a gear motor 50, the output shaft 51 of which carries a grooved pulley 52. The pulley 52 receives one or more elastic belts 53 which extend around the annularly concave contours of the poteye side wall 54. In this respect, it will be understood that the conventional, commonly available poteye is configured with the generally outwardly facing U-shaped cross sectional contour of its side wall, substantially as reflected in FIG. 3, so that no machining or other preparation of the poteye is required to accommodate the driving belts 53. In a typical commercial installation, a poteye having a central opening of about six inches and an overall diameter of about eight inches is very suitable. A poteye of this size has an overall height of about 2½ inches.

With reference to FIG. 1, in the system of the invention, when a twist condition in the fabric is detected at the twist sensor 18, a twist sensor control 55 actuates a turntable drive 56 and, simultaneously, the gear motor 50, so that both the turntable 12 and the rotatable poteye 31 are rotated in substantial synchronism and throughout a substantially equal rotational displacement. Fabric, which at this time is passing upwardly through the poteye 31 and between the resiliently biased rollers 45, 46, is firmly gripped and controlled by the rollers. Accordingly, rotational motions of the poteye 31 and the rollers 45, 46 mounted thereon, are translated directly into detwisting or untwisting rotation of the fabric rope. By reason of the close coupled relationship of the gripping rollers 45, 46 and the lifting roller 13, the untwisting motion is immediately effective on the discharge side of the lifting roller and is quickly sensed by the twist sensor 18, so that rotation of the turntable 12 and the upper level detwisting mechanism is discontinued very quickly after the twist condition has been remedied.

As an additional advantageous feature, the upper level detwisting mechanism of the invention preferably includes a simple, inexpensive, yet highly reliable safety shut-off device, which operates in the event of a knot, tangle or other obstruction in the fabric rope, to shut off the drive to the lifting roller 13 before the obstruction can be drawn up into the detwisting mechanism, possibly damaging the mechanism or the fabric or both. With reference to FIG. 3, a pivot bracket 60 is mounted on the bottom surface 25 of the detwister support 24 and carries a pair of spaced-apart angle members 61, which are pivotally mounted on the brackets 60 by means of bolts 62. A standard poteye 63 is carried near the outer ends of the angle members 61. The poteye 63 can be formed of stainless steel material and can be of the same general construction as the poteye 31. The poteye 63, however, is of smaller diameter than the poteye 31, for example, 4 or 5 inches in diameter versus 6 inches in diameter for the upper poteye 31. In the illustrated arrangement, the poteye 63 is affixed to a pair of transverse angle members 64, 65, which are bolted to the primary angle members 61. The arrangement of the lower poteye 63 is such that the fabric rope 11 normally passes therethrough freely but with less clearance than through the upper, rotatable poteye 31. Accordingly, any fabric passing through the lower poteye will comfortably pass through the upper one.

As shown in FIG. 3, the pivot arms 61, by reason of the unbalanced weight of the poteye 63, tend to pivot counterclockwise to a lower limit position, as determined by a limit stop element 70. In addition, it is desirable to resiliently bias the pivot arm 61 to such limit position by means of a relatively heavy spring 71, so that the pivot arms will be displaced upward only by relatively substantial force.

In the operation of the equipment, if the fabric rope is knotted, or severely tangled such as to present an obstruction that cannot pass easily through the poteye 63, the poteye and the pivot arms will be lifted against the unbalanced weight and the resistance of the spring 71. A sensor element 72 is positioned to detect such movement and, through a control 73 (FIG. 1), to instantly shut down the drive 14 for the lifting roll. This prevents the detwisting mechanism and/or the fabric from becoming damaged through the application of excessive pulling forces on the fabric, which might otherwise be unable to pass through the rotary poteye 31.

The mechanism of the invention is uniquely advantageous in terms of its simplified, highly economical, rugged construction, while also providing entirely reliable and functional performance. By using a simple rotatably mounted annular member, preferably an inexpensive, commonly available poteye, which is rotatably mounted on its support by a plurality of grooved support rollers, and mounts resiliently biased gripping rollers at its upper end, the primary functional elements of the detwisting mechanism can be fabricated and installed and reliably operated at absolute minimum cost. The extremely favorable cost to performance aspects of the new device render it highly attractive for installation in detwisting systems, many of which currently are operated without upper level detwisting mechanisms, notwithstanding the performance penalties of such arrangements.

The mechanism of the invention additionally incorporates a highly simplified and economical safety shut-off mechanism which, while using economical and readily available components, provides a fully functional and reliable device to avoid damage to the system resulting from knots, tangles, etc., in the rope-form fabric.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a system for de-twisting tubular knitted fabric in preparation for further processing, the system including an open top container for holding said tubular knitted fabric in rope form, a lifting roller for lifting fabric from said container, twist sensing means located to receive fabric from said lifting roller, a controllably rotatable turntable supporting said container and responsive to said twist sensor for rotating said container in a direction to correct a twist condition, and an elevated de-twisting mechanism positioned between said container and said lifting roller and responsive to said twist sensor for rotating the elevated fabric in a direction to correct a twist condition, an improved elevated de-twisting mechanism which comprises, (a) a rigid support structure mounted directly above said turn table and closely adjacent to said lifting roller, (b) said support structure forming an opening for the upward passage of rope form fabric from said container, (c) a poteye carried in said support structure and having a generally circular central opening of a size to accommodate passage of said rope form fabric and defining an axis of said poteye, (d) said poteye having upper and lower radially outwardly extending flanges and an arcuate side wall joining said flanges and defining an outwardly concave outwardly opening annular groove and an inwardly convex inner guide surface for fabric conveyed upwardly by said lifting roller, (e) means supporting said poteye for rotation about an axis generally aligned with the rope fabric being lifted by said lifting roller, (f) a controllable, reversible drive motor mounted on said support structure and having an output pulley, (g) drive means connecting said pulley and said poteye, for controllably rotating said poteye in either direction, and (h) resiliently biased fabric engaging means mounted on said poteye for rotation therewith and having means for resiliently gripping fabric at a point between said poteye and said lifting roller and closely adjacent to the latter.

2. A de-twisting mechanism according to claim 1, wherein (a) said means supporting said poteye for rotation comprises a plurality of at least three annularly grooved support rollers mounted by said support structure for rotation about axes parallel to the axis of said poteye and arranged in supporting engagement with said poteye, (b) the lower flange of said poteye being received in annular grooves in said support rollers.

3. A de-twisting mechanism according to claim 2, wherein (a) said fabric engaging means being mounted on the upper flange of said poteye.

4. A de-twisting mechanism according to claim 3, wherein (a) said fabric engaging means comprise first and second pairs of pivot arms mounted on opposite sides of said upper flange for pivoting means toward and away from the axis of said poteye, (b) each of said pair of pivot arms mount a fabric engaging roller at their upper ends, and (c) resilient means are provided for urging said pivot arms and rollers toward each other and into gripping contact with rope form fabric passing upwardly through said poteye and between said rollers.

5. A de-twisting mechanism according to claim 1, wherein (a) said drive means comprises elastic belt means trained about said drive pulley and received in the annular groove formed by said poteye.

6. A de-twisting mechanism according to claim 1, further including (a) a second poteye, of smaller size than the first mentioned poteye, movably mounted below said first mentioned poteye and substantially aligned with the rope form fabric being lifted through said first mentioned poteye by said lifting roller, (b) sensing means associated with said second poteye and operative upon upward movement of said poteye to halt operation of said lifting roller.

7. A de-twisting mechanism according to claim 6, wherein (a) said second poteye being carried by movable arms pivoted on said rigid support structure, (b) abutment means cooperating with said movable arms to provide a limit position of downward pivoting movement of said poteye.

8. In combination with a fabric de-twisting mechanism positioned between a rotatable supply of rope form fabric and a controllably driven lifting roller for extracting said fabric from said supply, a control device which comprises, (a) a poteye having a central opening of predetermined size to accommodate the free passage therethrough of rope form fabric in normal condition, (b) means mounting said poteye for limited vertical movement at a location between said rotatable supply and said de-twisting mechanism, (c) means defining a lower limit position for said poteye, and (d) sensing means for sensing predetermined upward movement of said poteye and, in response thereto, halting operation of said lifting roller.

9. In a system for de-twisting tubular knitted fabric in preparation for further processing, the system including an open top container for holding said tubular knitted fabric in rope form, a lifting roller for lifting fabric from said container, twist sensing means located to receive fabric from said lifting roller, a controllably rotatable turntable supporting said container and responsive to said twist sensor for rotating said container in a direction to correct a twist condition, and an elevated de-twisting mechanism positioned between said container and said lifting roller and responsive to said twist sensor for rotating the elevated fabric in a direction to correct a twist condition, an improved elevated de-twisting mechanism which comprises, (a) a rigid support structure mounted directly above said turn table and closely adjacent to said lifting roller, (b) said support structure forming an opening for the upward passage of rope form fabric from said container, (c) an annular guide member having a central axis and carried by said support structure for rotation about its axis, (d) said annular guide member having a central opening for the free passage of fabric in rope form, (e) fabric engaging means mounted on said annular guide member for rotation therewith, (f) said fabric engaging means comprising an opposed pair of rollers mounted for rotation about parallel axes disposed at right angles to the central axis of said annular guide member, (g) means for resiliently urging said rollers toward said central axis for gripping engagement with a rope form fabric passing though said annular guide member, and (h) controllable reversible drive means associated with said annular guide member and responsive to said twist sensor for rotating said annular guide member in a direction to correct a twist condition.

10. A de-twisting mechanism according to claim 9, wherein (a) said annular guide member includes a radially outwardly extending flange, (b) said support structure includes a plurality of at least three annularly grooved rollers mounted for free rotation and receiving said flange in annular grooves formed in said rollers, (c) said annular guide member being supported exclusively by said groove rollers.

11. A de-twisting mechanism according to claim 10, wherein (a) said annular guide member has an annularly grooved side wall adjacent to said flange, (b) said drive means comprising a reversible motor mounted on said support structure adjacent to said annular guide member and having a drive pulley adjacent to said grooved side wall, and (c) elastic drive belt means are trained about said drive pulley and said grooved side wall for controllably rotating said annular guide member.

12. A de-twisting mechanism according to claim 11, wherein (a) said annular guide member is a poteye.

13. A de-twisting mechanism according to claim 9, further including, (a) a second annular guide member movably positioned below said first mentioned guide member and having a central opening of smaller diameter than said first mentioned guide member, (b) means mounting said second annular guide member for limited upward movement from a normal position, and (c) sensing means responsive to said limited upward movement for halting operation of said lifting roller.

14. A detwisting mechanism according to claim 9, wherein (a) limit stops are provided whereby the at-rest position of said rollers is such that said rollers are slightly separated.

* * * * *